US005253627A

United States Patent [19]

Miyata et al.

[11] Patent Number: 5,253,627

[45] Date of Patent: Oct. 19, 1993

[54] BURNING CONDITION DETECTING DEVICE AND BURNING CONTROL DEVICE IN AN INTERNAL COMBUSTION ENGINE

[75] Inventors: Shigeru Miyata; Hideji Yoshida; Yoshihiro Matsubara; Yasuo Ito, all of Nagoya, Japan

[73] Assignee: NGK Spark Plug Co., Ltd., Nagoya, Japan

[21] Appl. No.: 988,842

[22] Filed: Dec. 10, 1992

[30] Foreign Application Priority Data

| | | | |
|---|---|---|---|
| Dec. 10, 1991 | [JP] | Japan | 3-026138 |
| Mar. 11, 1992 | [JP] | Japan | 4-052041 |
| Jul. 1, 1992 | [JP] | Japan | 4-174398 |

[51] Int. Cl.[5] ..... F02D 41/04

[52] U.S. Cl. ..... 123/435; 123/679; 123/685

[58] Field of Search ..... 123/425, 435, 672, 679, 123/685; 73/35

[56] References Cited

U.S. PATENT DOCUMENTS

| | | | |
|---|---|---|---|
| 2,467,732 | 4/1949 | Davis | 123/435 |
| 4,232,545 | 11/1980 | Dobler et al. | 123/435 X |
| 4,417,556 | 11/1983 | Latsch | 123/435 X |
| 4,557,236 | 12/1985 | Showalter | 123/435 |
| 4,715,341 | 12/1987 | Douaud et al. | 123/435 X |
| 4,724,812 | 2/1988 | Akagi | 123/435 |
| 4,913,118 | 4/1990 | Watanabe | 123/435 |
| 5,036,669 | 8/1991 | Earleson et al. | 123/435 X |
| 5,058,552 | 10/1991 | Shimomura et al. | 123/435 X |
| 5,067,459 | 11/1991 | Ma | 123/435 X |
| 5,107,816 | 4/1992 | Katogi et al. | 123/435 |

*Primary Examiner*—Willis R. Wolfe

*Attorney, Agent, or Firm*—Sughrue, Mion, Zinn, Macpeak & Seas

[57] ABSTRACT

In a burning condition detecting device in an internal combustion engine in which a high voltage is applied to a spark plug by way of a diode and a series gap of a distributor. A voltage charger circuit is provided to on-off actuates the primary coil to induce a charging voltage in the secondary circuit either during establishing the spark discharge or during a predetermined period of time immediately after an end of the spark discharge. The charging voltage is applied to the spark plug to electrically charge a stray capacity inherent in the spark plug so as to form a sparkplug voltage. A voltage divider circuit is provided to divide the sparkplug voltage in accordance with a high impedance element and a low impedance element. A voltage level detecting circuit is provided to detect a sparkplug voltage waveform divided by the voltage divider circuit. A distinction circuit detects a degree of variation of an attenuation time period of the spark plug voltage waveform so as to determine a variation of an air-fuel ratio of an air-fuel mixture gas injected into a cylinder of the internal combustion engine by a fuel injector.

7 Claims, 8 Drawing Sheets

BURNING CONDITION DETECTING DEVICE AND BURNING CONTROL DEVICE IN AN INTERNAL COMBUSTION ENGINE

BACKGROUND OF THE INVENTION

1. Field of the Invention

This invention relates to a burning condition detecting device and burning control device in an internal combustion engine which is capable of detecting and controlling an air-fuel ratio of an air-fuel mixture gas at a lean limit and a theoretical range so as to ensure a stable running of the internal combustion engine.

2. Description of Prior Art

With the demand of purifying emition gas and enhancing fuel efficiency of internal combustion engine, it has been desired to detect burning condition in each cylinder of the internal combustion engine so as to run the engine at a lean limit of an air-fuel ratio. With the combination of a pumping element and an oxygen sensor, an air-fuel sensor is used to detect an air-fuel ratio of the air-fuel mixture gas on the basis of an oxygen component and an unconsumed fuel in the exhaust gas to carry out a lean burning in each cylinder of the internal combustion engine.

In a burning control device using the air-fuel sensor, however, the air-fuel ratio is controlled to normally burn the leanest air-fuel mixture gas by considering the concentration variation of the mixture gas depending on the cylinder of the internal combustion engine. For this reason, the air-fuel ratio of the mixture gas tends to be greater so as to invite difficulty in purifying emition gas and enhancing fuel efficiency of internal combustion engine.

The invention is made on the basis of the fact that an electrical current variation flowing between electrodes of a spark plug increases with the air-fuel mixture gas approaching to a critical air-fuel ratio which is in a lower limit the internal combustion engine can run.

Therefore, it is an object of the invention to provide a burning condition detecting device and burning control device which is capable of controlling an air-fuel mixture gas in each cylinder at a critical air-fuel ratio which is in a lower limit the internal combustion engine can run.

SUMMARY OF THE INVENTION

According to the invention, there is provided a burning condition detecting device in an internal combustion engine. A primary coil of an ignition coil is on-off actuated to induce a high voltage across a secondary coil during a sparking discharge period of time or immediately after an end of the sparking discharge between electrodes of a spark plug. The high voltage (5~7 KV) is enough to break down a rotor gap (series gap) of a distributor, and applied to the spark plug through the series gap and a diode so as to electrically charge a stray capacity inherent in the spark plug. The electrical charge stored in the spark plug is discharged as an ionized current across the electrodes. An amount of the electrical discharge varies depending on ionized particles appeared around the electrodes when the sparking discharge ignites an air-fuel mixture gas. The variation of the electrical discharge increases as an air-fuel ratio of the mixture gas approaches a lean burning limit, and a certain limit which an exhaust gas recirculation can be carried out.

According further to the invention, there is provided a burning condition detecting device in an internal combustion engine. Immediately after a sparking discharge of a spark plug, an electrical energy resided in an ignition coil electrically charges the spark plug a stray capacity inherent in the spark plug through a diode and a series gap. An electrical charge stored in the spark plug is discharged between its electrodes immediately after an end of the sparking discharge. Whether the discharge is slowly or rapidly depends on ionized particles appeared around the electrodes when the sparking discharge ignites an air-fuel mixture gas. This causes to vary an attenuation time period of the electrical discharge. The measurement of the attenuation time variation makes it possible to control an air-fuel ratio of the mixture gas and an amount of an exhaust gas recirculation within a limit which the engine can run.

According to the invention, there is provided a burning control device in an internal combustion engine. With the use of an air-fuel sensor, an air-fuel ratio of an air-fuel mixture gas is controlled by a feedback system to be a lean air-fuel ratio which is predetermined according to running condition of the internal combustion engine. Variation of the air-fuel ratio in each cylinder of the internal combustion engine is detected to control an injected fuel so that the air-fuel ratio in each cylinder is a lean limit which the mixture gas can be normally ignited.

According further to the invention, there is provided a burning control device in an internal combustion engine. With the use of an air-fuel sensor, an air-fuel ratio of an air-fuel mixture gas is controlled on the basis of a feedback system to be a target air-fuel ratio which is predetermined according to running condition of the internal combustion engine. Variation of the air-fuel ratio in each cylinder of the internal combustion engine is detected to adjust variation of a burning condition in each cylinder of the internal combustion engine.

According furthermore to the invention, there is provided a burning control device in an internal combustion engine. With the use of an oxygen sensor which detects whether an air-fuel ratio of an air-fuel mixture gas is one or not, the air-fuel ratio is controlled on the basis of a feedback system to be a theoretical air-fuel ratio which is predetermined according to running condition of the internal combustion engine. Variation of the air-fuel ratio in each cylinder of the internal combustion engine is detected to adjust variation of a burning condition in each cylinder of the internal combustion engine.

According still further to the invention, there is provided a burning control device in an internal combustion engine. The invention is made on the basis of the finding that an angular velocity variation of a crank increases with the advancement of a lean burning in each cylinder of the internal combustion engine. An air-fuel ratio of an air-fuel mixture gas is controlled by a feedback system to be a lean air-fuel ratio which is predetermined according to running condition of the internal combustion engine. Variation of the air-fuel ratio in each cylinder of the internal combustion engine is detected to control an injected fuel so that the air-fuel ratio in each cylinder is within a lean limit which the mixture gas can be normally ignited.

According further to the invention, there is provided a burning control device in an internal combustion engine. The invention is made on the basis of the finding that a combustion pressure variation in each cylinder increases with the advancement of a lean burning in each cylinder of the internal combustion engine. An air-fuel ratio of an air-fuel mixture gas is controlled by a feedback system to be a lean air-fuel ratio which is predetermined according to running condition of the internal combustion engine. Variation of the air-fuel ratio in each cylinder of the internal combustion engine is detected to control an injected fuel so that the air-fuel ratio in each cylinder is within a lean limit which the mixture gas can be normally ignited.

These and other objects and advantages of the invention will be apparent upon reference to the following specification, attendant claims and drawings.

BRIEF DESCRIPTION OF THE DRAWINGS

FIG. 2*a* is a schematic diagram view of a control circuit according to a first modification form of the invention;

DETAILED DESCRIPTION OF THE EMBODIMENTS

Figure 1:
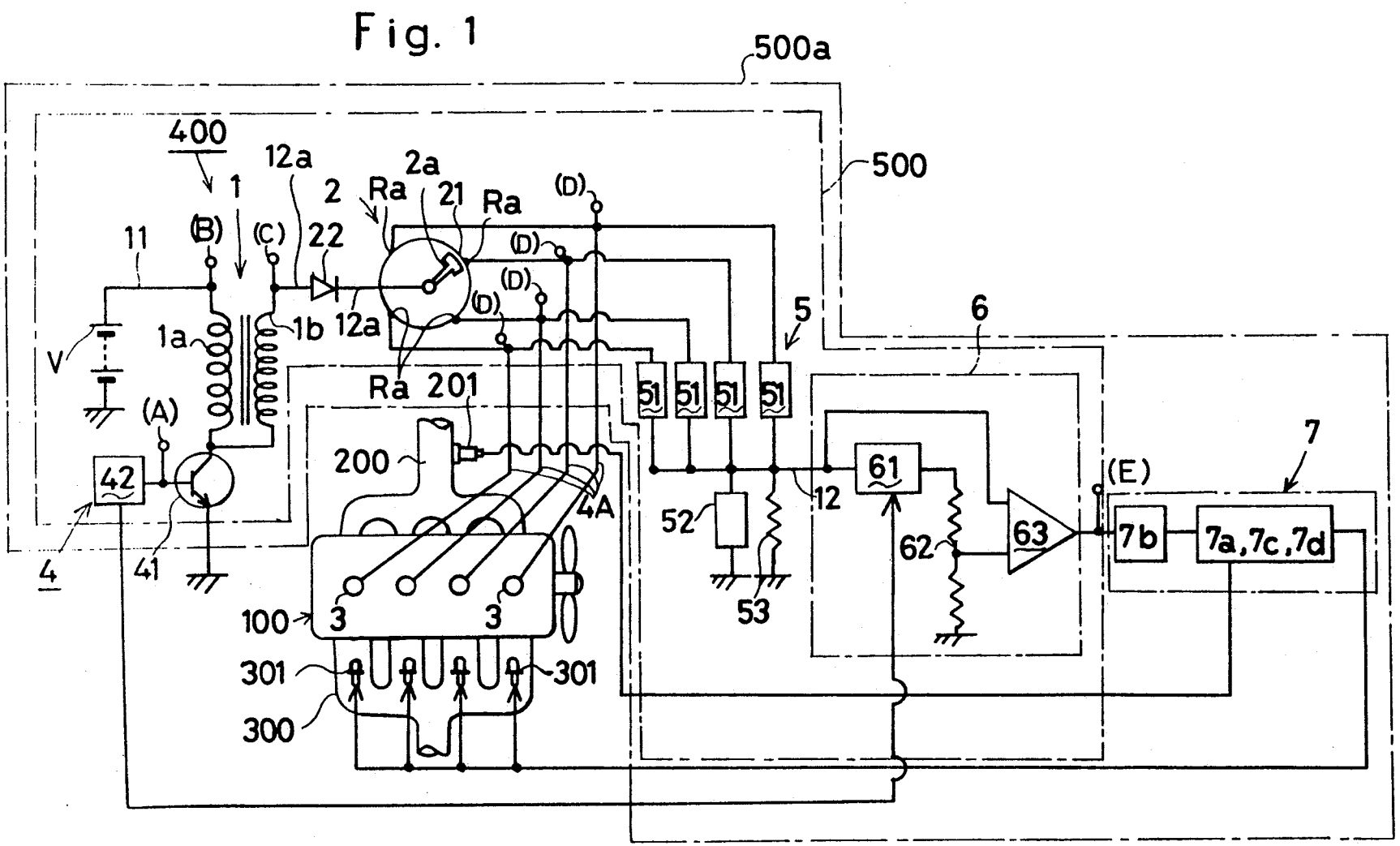
FIG. 1 is a schematic view of an internal combustion engine into which a burning condition detecting device and burning control device is incorporated.

Referring to FIG. 1 which shows a schematic view of an internal combustion engine 100 into which a burning detecting device 500 and a burning control device 500*a* are incorporated. In an exhaust path 200 of the internal combustion engine 100, is an air-fuel (A/F) sensor provided which has a combination of pumping element and an oxygen sensor to detect an air-fuel ratio in an air-fuel mixture gas on the basis of an oxygen component and uncosumed fuel component of the mixture gas. In an intake path 300, is a fuel injector 301 provided which injects an appropriate amount of fuel into each cylinder of the internal combustion engine 100.

In an ignition system 400, there is provided has a primary circuit 11 having an ignition coil 1 which includes a primary coil 1*a*, and a secondary circuit 12*a* having a secondary coil 1*b* with a vehicular battery cell (V) as a power source. The primary coil 1*a* is electrically connected in series with a switching device 41 and a signal generator 42 to form an on-off actuating circuit 4, while the secondary coil 1*b* is electrically connected to a rotor 2*a* of a distributor 2 by way of a diode 22. The distributor 2 has stationary segments (Ra), the number of which corresponds to that of the cylinders of the internal combustion engine 100. To each of the stationary segments (Ra), is an free end of the rotor 2*a* adapted to approaches so as to make a rotor gap 21 (series gap) with the corresponding segments (Ra). Each of the segments (Ra) is connected to a spark plug 3 by way of a sparkplug cable 4A. The spark plug 3 has a center electrode and an outer electrode to form a spark gap between the electrodes, across which a spark discharging occurs when energized.

The burning condition detecting device 500 includes the diode 22, a voltage charging circuit and a voltage divider circuit 5 which has a high impedance element 51 and a low impedance element 52 through which the sparkplug cable 4A is grounded. The voltage divider circuit 5 divides a sparkplug voltage in accordance with a ratio of the high impedance element 51 to the low impedance element 52. The on-off actuating circuit 4 serves as the voltage charging circuit to on-off actuate the primary coil 1*a* to induce a high voltage in the secondary coil 1*b* so as to electrically charge a static capacity inherent in the spark plug 3 at a predetermined time after an end of the sparking discharge. To a common line 12 between the high impedance element 51 and the low impedance element 52, is an attenuation detecting circuit 6 connected to detect an attenuation characteristics of a sparkplug voltage waveform. To the attenuation detecting circuit 6, is a control circuit 7 to detect a variation degree of the attenuation characteristics of the sparkplug voltage waveform as described hereinafter.

The on-off actuating circuit 4 detects a crank angle and a throttling degree of the engine to on-off actuate the primary coil 1*a* to induce the high voltage in the secondary coil 1*b* so that the timing of the spark corresponds to an advancement angle relevant to a revolution and load of the internal combustion engine 100.

In the voltage divider circuit 5, a capacitor (1 pF) serves as the high impedance element 51, while a capacitor (3000 pF) serves as the low impedance element 52 to divide the sparkplug voltage in accordance with the ratio of the capacitor (1 pF) to the capacitor (3000 pF). To the low impedance element, is an electrical resistor 53 (e.g. 2 MΩ) connected in parallel therewith so as to form a discharge path for the capacitor 52.

The voltage divider circuit 5 allows to divide the sparkplug voltage by the order of 1/3000, which makes it possible to determine a time constant of RG path to be approximately 6 milliseconds to render an attenuation time length relatively longer (3 milliseconds) as described hereinafter. Then the sparkplug voltage of 30000 V is divided to a level of 10 V, and inputted to the attenuation detecting circuit 6.

The attenuation detecting circuit 6 has a peak hold circuit 61, to which an output from the voltage divider circuit 5 is fed. The attenuation detecting circuit 6 has a resistor circuit 62 which divides an output from the peak hold circuit 61, and having a comparator 63 to compare an output voltage from the resistor circuit 62 with an output voltage (reference voltage) from the voltage divider circuit 5, and producing a pulse to detect such a time length as to hold more than a predetermined voltage level in the sparkplug voltage waveform divided by the voltage divider circuit 5.

The control circuit 7 has a feedback means 7*a*, a distinction means 7*b*, an adjusting means 7*c* and a renewal means 7*d*, each means of which is referred to as a circuit for the purpose of convinience hereinafter. The feedback circuit 7*a* controls an amount of the fuel from the fuel injector 301 in each cylinder, and feeding back to an air-fuel sensor 201, so that the air-fuel ratio (A/F)

of the mixture gas is a lean air-fuel ratio which is predetermined on the basis of the stored data experimentally measured or calculated according to the running condition of the internal combustion engine 100.

The distinction circuit 7b detects an air-fuel ratio of the air-fuel mixture gas corresponding to a stable burning limit of the internal combustion engine 100 on the basis of the attenuation detecting circuit 6.

The adjusting circuit 7c adjusts an amount of fuel injected from the injector 301 to make the air-fuel ratio of the air-fuel mixture gas approach to a critical air-fuel ratio substantially corresponding to that of the stable burning limit in each cylinder of the internal combustion engine 100.

The renewal circuit 7d renews the lean air-fuel ratio to approach it to a target air-fuel ratio which is determined on the basis of the critical air-fuel ratio.

In the control circuit 7, the amount of the fuel injected from the injector 301 is controlled so that the air-fuel ratio of the air-fuel mixture gas is the lean air fuel ratio (e.g. 20:1) which is leaner than a stoichiometric air-fuel ratio which is determined to be rather fuel-rich considering the air-fuel ratio variation in each cylinder of the internal combustion engine 100. The air-fuel ratio is detected by the air-fuel sensor 201, and fed back to the injector 301 so as to obviate the difference from the target air-fuel ratio.

The air-fuel ratio in each cylinder of the internal combustion engine 100 is adjusted to be the critical air-fuel ratio substantially corresponding to that of the stable burning limit in each cylinder of the internal combustion engine 100 in the following manner.

Figure 2:
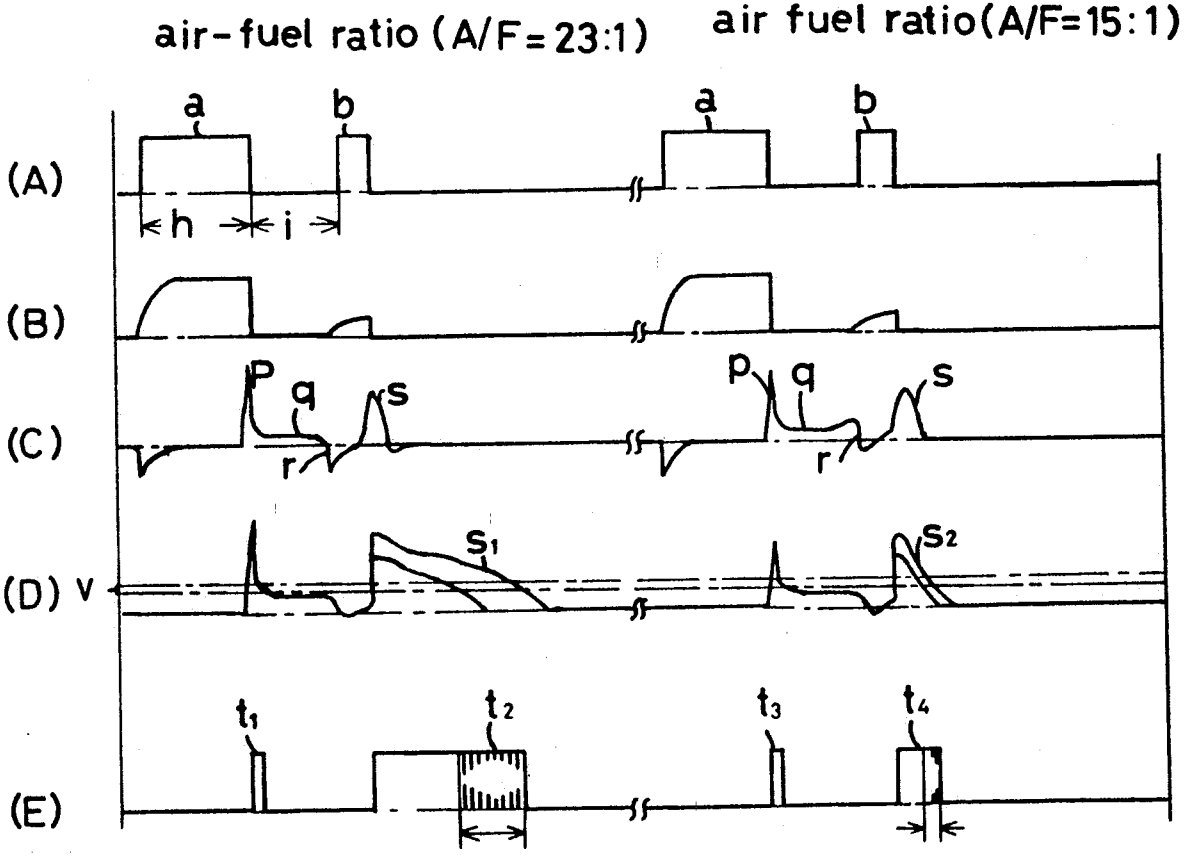
FIGS. 2(A)-(E) show sparkplug voltage waveforms for the purpose of explaining how the burning condition detecting device works.

The signal generator 42 generates pulse signals (a), (b) as shown at (A) in FIG. 2 in order to induce a primary current in the primary circuit 11 as shown at (B) in FIG. 2. Among the pulse signals, the pulse (A) of wider width (h) energizes the spark plug 3 to establish the spark between the electrodes of the spark plug 3. The pulse (b) following the pulse (a) delays by the time (i) of 0.5 ~ 1.5 ms. The pulse (b) has a thinner width to electrically charge the stray capacity inherent in the the spark plug 3.

With the actuation of the on-off actuating circuit 4, the sparkplug voltage appears in the secondary coil 1b of the secondary circuit 12a as shown at (C) in FIG. 2. Due to the high voltage (p) established following the termination of the pulse signal (a), the sparking discharge starts to occur between the electrodes, and accompanying an inductive discharge voltage waveform (q).

In response to the pulse signal (b), a counter-electromotive voltage accompanies a negative voltage waveform (r) flowing through the secondary circuit 12a, and a voltage waveform (s) follows.

Due to an electrical energy stored in the ignition coil 1 when the primary coil 1a is energized, the sparkplug voltage is enhanced again to induce the voltage waveform (s) through the secondary circuit 12a when the primary coil 1a is deenergized.

The enhanced voltage level is determined as desired by the delay time (i) and the width of the pulse signals (b). The level of the voltage waveform (s) is 4–6 KV, the magnitude of which is enough to break down the rotor gap 21, but not enough to establish a discharge between the electrodes of the spark plug 3 when the air-fuel mixture gas staying in the spark gap is free from ionized particles.

The diode 22 prevents an electrical charge (3–5 KV) in the spark plug 3 from being released to the ignition coil 1 by way of the rotor gap 21 so as not to drop the voltage of the spark plug 3. This makes it possible to store the electrical charge (3–5 KV) in the stray capacity (usually 10–20 pF) inherent in the spark plug 3.

The charged voltage in main from the stray capacity inherent in the spark plug 3, is released as ionized current as shown at (D) in FIG. 2. Width variation of the discharged current waveform is in the narrow range as shown at (S2) when the air-fuel ratio is generally 15:1. When the air-fuel ratio approaches 23:1 (lean burning limit), width variation of the discharged current waveform is in the exceedingly wider range as shown at (S1).

The width variation of the discharged current waveform is detected by the attenuation detecting circuit 6 in the following manner.

A peak voltage of the charged voltage is held by the peak hold circuit 61, and the peak voltage is divided by $\frac{1}{3}$ to provide a reference voltage (v) which is compared with an output voltage waveform by the comparator 63. The comparator 63 determines a time length which holds the output voltage waveform higher than the reference voltage (v) to generate pulses t1 ~ t4 as shown at (E) in FIG. 2. The pulses t1 ~ t4 are fed to the control circuit 7. The width of the pulses t2, t4 corresponds to a magnitude of the attenuation time variation of the charged voltage waveform. The pulse t2 shows that the attenuation time variation of the charged voltage waveform is great when an air-fuel ratio of the air-fuel mixture gas generally corresponds to the stable burning limit in each cylinder of the internal combustion engine 100. In the control circuit 7, the variation of the concecutive ten pulses t2 deviated from the reference value is totaled in each cylinder of the internal combustion engine 100. When the total amount of the deviation exceeds a predetermined value, it is detected that the air-fuel ratio approaches to the critical air-fuel ratio generally corresponding to that of the stable buring limit in each cylinder of the internal combustion engine 100. On the basis of the information thus detected, the amount of the fuel from the injector 301 is adjusted to carry out the lean burning in each cylinder of the internal combustion engine 100. In this instance, the renewal circuit 7d of the control circuit 7 renews the lean air-fuel ratio (20:1) to approach it to approach it to the target air-fuel ratio (e.g. 22:1) which is determined on the basis of the critical air-fuel ratio totaled in each cylinder of the internal combustion engine 100 in adjusting the amount of the fuel from the injector 301.

Figure 2A:
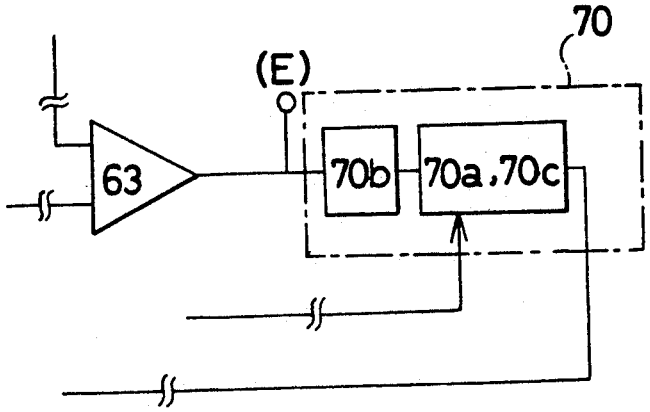

As a first modification form of the control circuit, a control circuit 70 is employed as shown in FIG. 2a.

The control circuit 70 has a feedback circuit 70a which adjusts an amount of the fuel from the injector 301 in each cylinder of the internal combustion engine 100, and feeding back to the injector 301 so that the air-fuel ratio of the air-fuel mixture gas become a target air-fuel ratio which is predetermined on the basis of the stored data experimentally measured or calculated according to the running condition of the internal combustion engine 100.

In accompany with the fuel injection adjustment, the attenuation detection circuit 6 detects a variation of the air-fuel ratio in each cylinder, and accumulating deviation from the reference value of the pulse t2 which corresponds to the air-fuel ratio in each cylinder of the internal combustion engine 100. The injector 301 is controlled to reduce the deviation from the reference value of the pulse t2 to decrease the variation of the air-fuel ratio in each cylinder of the internal combustion engine 100.

In the control circuit 70, the injector 301 is controlled to make the target air-fuel ratio approach to e.g. 22:1 which is leaner than the stoichiometric air-fuel ratio predetermined on the basis of the variation of air-fuel ratio in each cylinder of the internal combustion engine 100. The target air-fuel ratio is detected by the air-fuel sensor 201, and fed back so as to eliminate the deviation from the target value. Meanwhile, the attenuation detecting circuit 6 detects the variation of the air-fuel ratio in each cylinder to adjust it with a total amount of the injected fuel unchanged.

In FIG. *2a*, numerals 70*b*, 70*c* respectively correspond to the distinction circuit 7*b*, 7*c* in the first modification form of the invention.

It is noted that it is possible to control the air-fuel ratio to approach to the critical air-fuel ratio which generally corresponds to that of the stable burning limit in each cylinder of the internal combustion engine 100 when the engine 100 is warm-up running from the cold-starting. In this instance, an apparent air-fuel ratio is controlled to be rather fuel-rich (e.g. 13:1).

Figure 3:
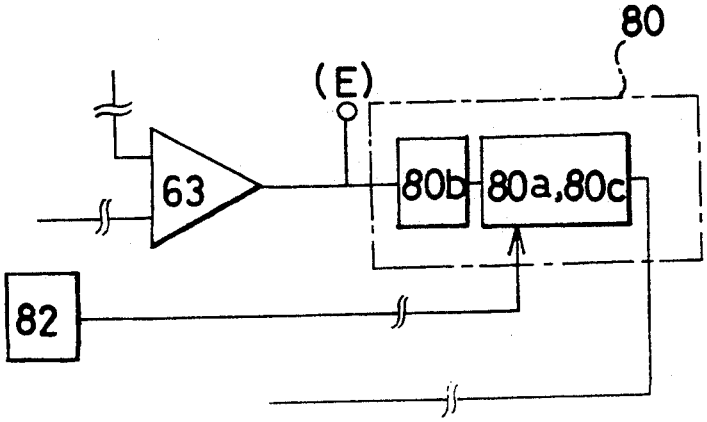
FIG. 3 is a schematic diagram view of a control circuit according to a first modification form of the invention.
Figure 3A:
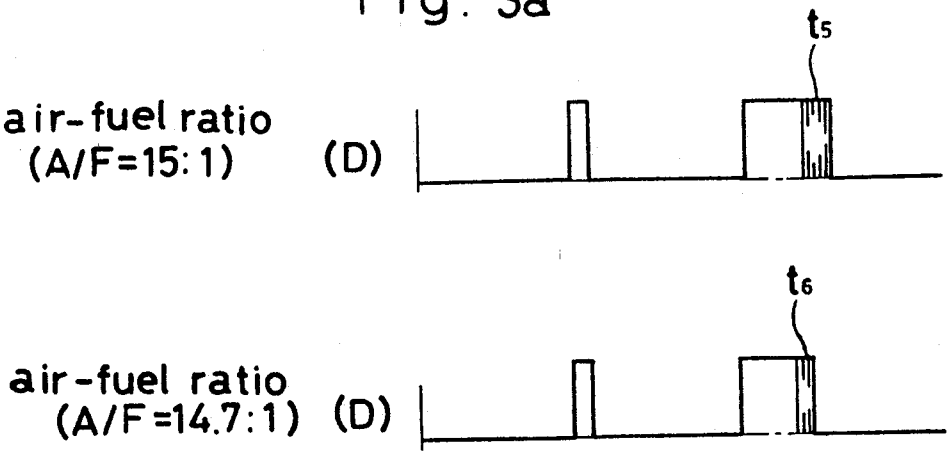
FIG. 3*a* is a view showing a variation of attenuation time period according to a second modification form of the invention.

As a second modification form of the control circuit, a control circuit 80 employs an oxygen sensor 82, an output voltage from which rapidly decreases because an oxygen component in the exhaust gas increases when the air-fuel ratio of the air-fuel mixture gas is leaner than the stoichiometric air-fuel ratio. For this reason, as shown in FIG. 3, the control circuit 80 has a feedback circuit 80*a* which controls the injector 301 in each cylinder to make the air-fuel ratio approach the stoichiometric air-fuel ratio. As shown at t5, t6 in FIG. *3a*, the variation of the attenuation time length of the output voltage waveform reduces so that the air-fuel ratio of the mixture gas becomes 15:1 or 14:7:1 in some cylinders. In this instance, the variation of the attenuation time length is exceedingly small, it is necessary to precisely detect the variation in each cylinder of the internal combustion engine 100.

In the control circuit 80, a feedback circuit 80*a* which adjusts an amount of the fuel from the injector 301 in each cylinder of the internal combustion engine 100, and feeding back to the injector 301 so that the air-fuel ratio of the air-fuel mixture gas become a stoichiometic air-fuel ratio ($\lambda=1$).

In accompany with the fuel injection adjustment, the attenuation detecting circuit 6 detects a variation of the air-fuel ratio in each cylinder of the internal combustion engine 100, and accumulating deviation from the reference value of the pulse t5 (t6) which corresponds to the air-fuel ratio in each cylinder of the internal combustion engine 100. The injector 301 is controlled to reduce the deviation from the reference value of the pulse t5 (t6) to decrease the variation of the air-fuel ratio in each cylinder of the internal combustion engine 100. Meanwhile, the attenuation detecting circuit 6 detects the variation of the air-fuel ratio in each cylinder to adjust it with a total amount of the injected fuel unchanged.

In FIG. 3. numerals 80*b*, 80*c* respectively correspond to the distinction circuit 7*b*, 7*c* in the first modification form of the invention.

The control circuit 80 is effectively employed to an Exhaust Gas Recirculation System (EGR) in which a part of the exhaust gas is returned to the air-intake system to be added to the air-fuel mixture gas. It is difficult to increase the exhaust gas recirculation rate to the stable burning limit in each cylinder when a variation of the exhaust gas recirculation rate differs by each cylinder of the internal combustion engine. However, the control circuit 80 makes it possible to effectively carry out the exhaust gas recirculation by detecting the variation of the exhaust gas recirculation rate on the basis of the air-fuel ratio in each cylinder of the internal combustion engine.

During the warm-up running from the cold-starting, it is necessary to increase the amount of the injection fuel so as to compensate a shortage of evaporation of the fuel in each cylinder of the internal combustion engine. In order to cope with the cold-starting, it is necessary to increase the apparent air-fuel ratio on the fuel-rich condition so as to make the mixture gas fall within a combustible range. Once starting the engine, it is necessary to adjust the air-fuel ratio in accordance with the warm-up running condition of the internal combustion engine. The control circuit 80 makes it possible to adjust the air-fuel ratio in each cylinder to an optimum air-fuel ratio in accordance with the warm-up running condition of the internal combustion engine.

It is observed that the voltage charging circuit may be provided independent of the on-off actuating circuit 4 used at the time of on-off actuating the primary coil 1*a*. It is also noted that in a distributorless ignitor, a diode is generally provided to prevent the backward flow of the current except when the high voltage is applied to a spark plug. In the invention, the diode functions as a checker of the backward flow of the sparkplug voltage.

The polarity of the ignition coil 1 may be positive or negative, but the positive polarity of the ignition coil 1 will do better in precisely detecting the output voltage waveform shown at (C), (D) in FIG. 2. It is noted that the on-off actuating timing may be determined with the crank angle of the engine as a reference, so that the ATDC (After Top Dead Center) is e.g. 10 degrees to precisely cope with the running condition of the engine such as a change of the engine revolution.

Figure 4:
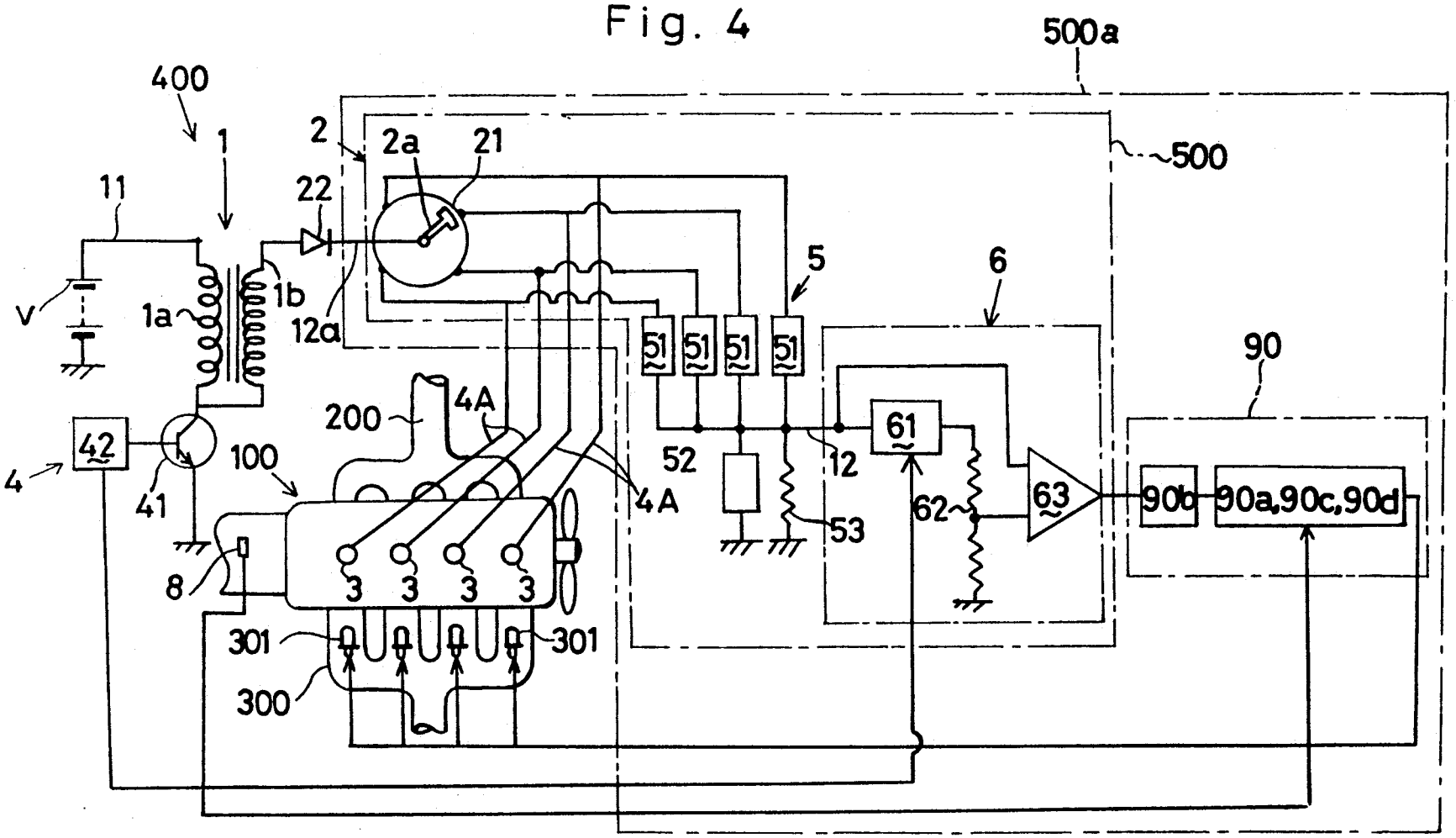
FIG. 4 is a schematic view similar to FIG. 1 according to a third modification form of the invention.
Figure 5:
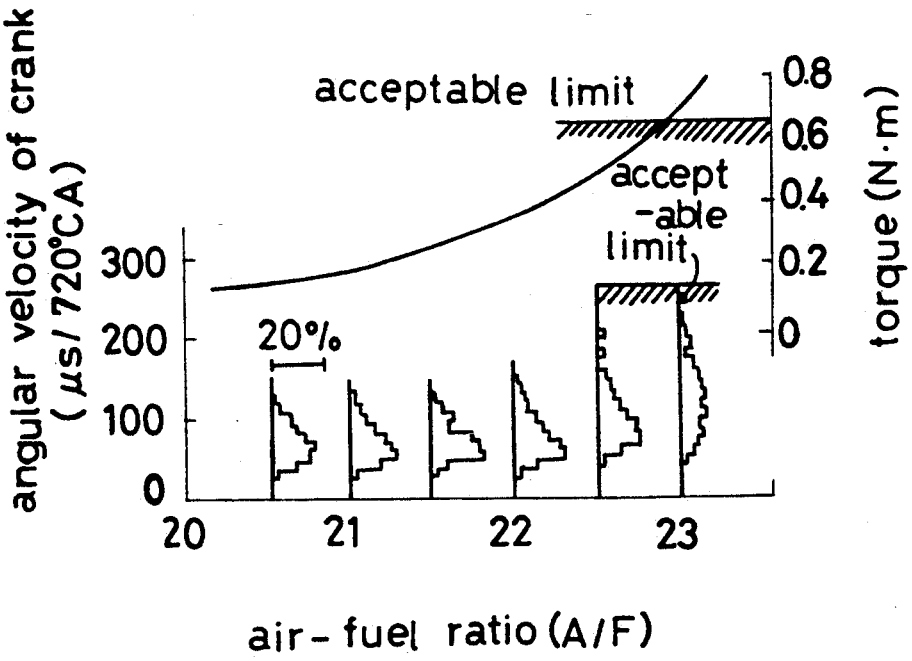
FIG. 5 shows a graph showing how an angular velocity of a crank varies depending on an air-fuel ratio according to the third modification form of the invention.

As a third modification form of the control circuit, a control circuit 90 employs an angular sensor 8 which detects an angular velocity of a crank in the internal combustion engine 100 as shown in FIG. 4. The angular velocity of the crank varies with the increase of the air-fuel ratio of the air-fuel mixture gas in each cylinder of the internal combustion engine 100. When the angular velocity of the crank varies so that the air-fuel ratio exceeds e.g. 22:1, it is impossible to maintain a stable burning condition in each cylinder of the internal combustion engine 100 as understood from FIG. 5.

The control circuit 90 further has a feedback circuit 90*a*, a distinction circuit 90*b*, an adjusting circuit 90*c* and an renewal circuit 90*d* as shown in FIG. 5*a*.

The angular sensor 8 controls the injector 301 in each cylinder to make the air-fuel ratio approach to the lean air-fuel ratio (e.g. A/F=20) which is capable of controlling the variation of the angular velocity of the crank within the predetermind value to maintain the stable burning condition in each cylinder of the internal combustion engine 100.

The feedback circuit 90*a* works as described in the first modification form of the invention.

The distinction circuit 90*b* detects an air-fuel ratio of the air-fuel mixture gas corresponding to a stable burning limit of the internal combustion engine 100 on the basis of an output from the attenuation detecting circuit 6.

The adjusting circuit 90c adjusts an amount of the injected fuel from the injector 301 to make the air-fuel ratio of the air-fuel mixture gas approach to a critical air-fuel ratio which is substantially corresponding to that of the stable burning limit in each cylinder of the internal combustion engine 100.

The renewal circuit 90d renews the lean air-fuel ratio to approach it to a target air-fuel ratio which is determined on the basis of the critical air-fuel ratio.

Figure 6:
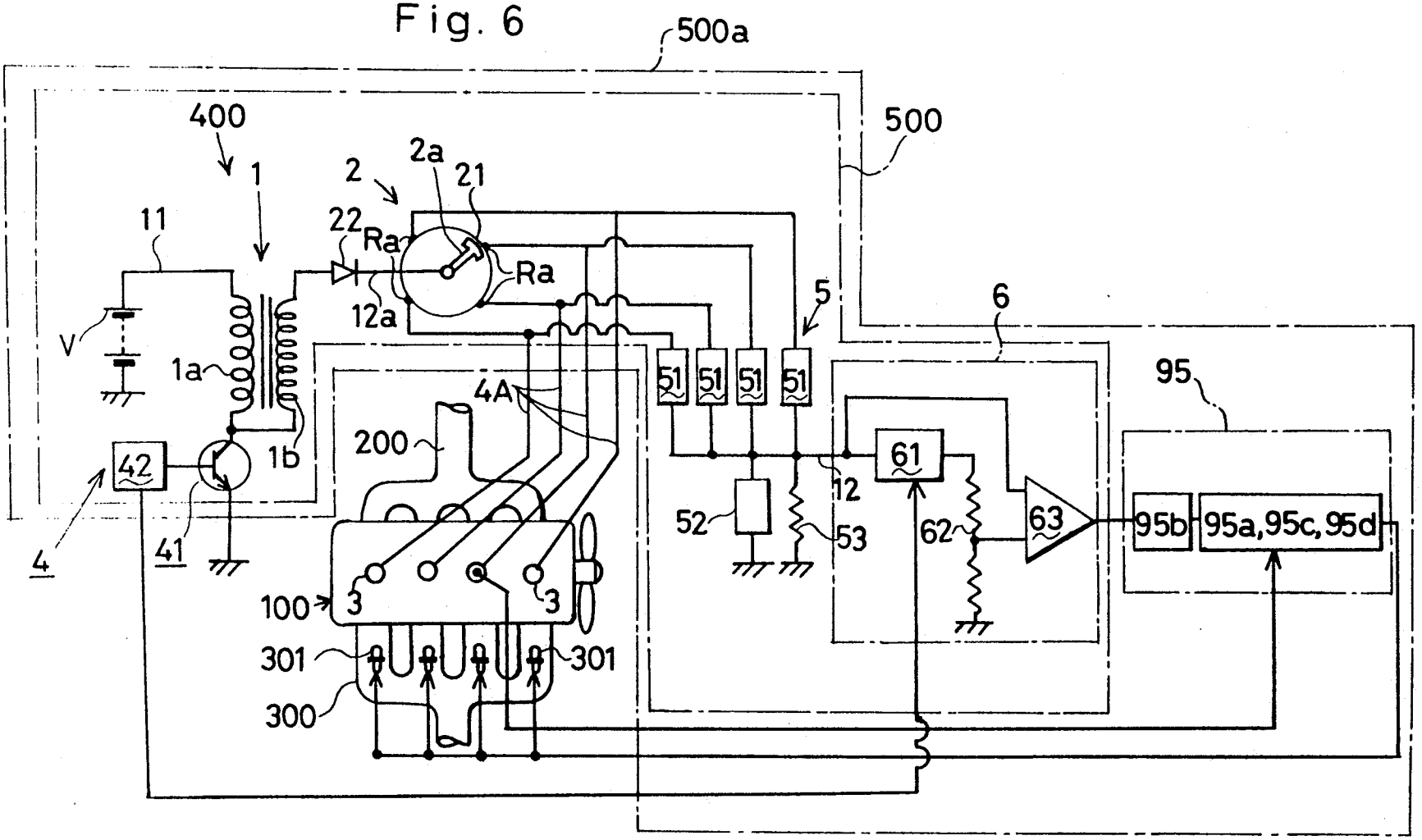
FIG. 6 is a view similar to FIG. 1 according to a fourth modification form of the invention.
Figure 7:
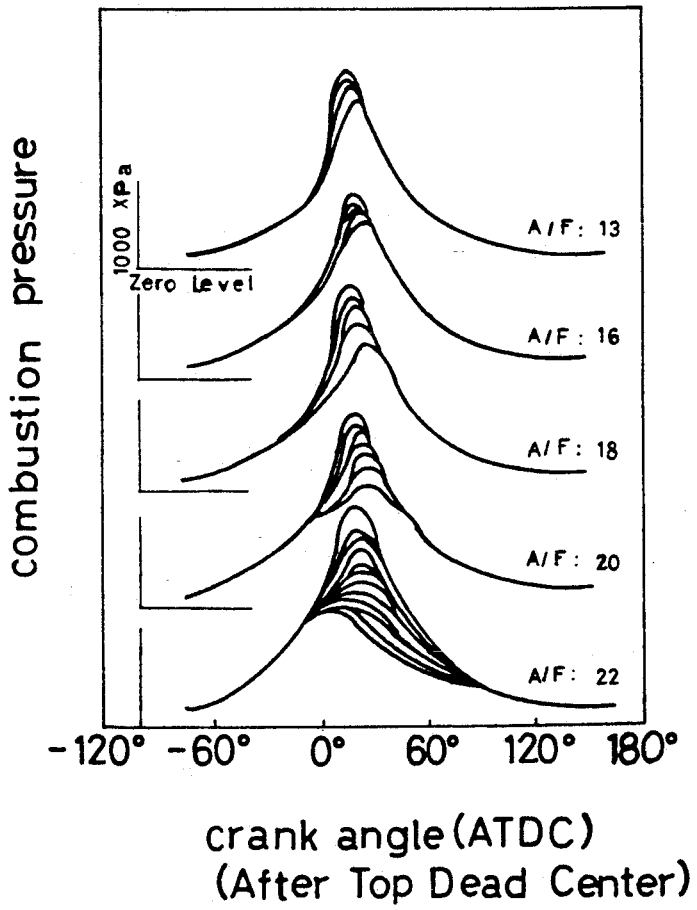
FIG. 7 is a graph showing how a combustion pressure in a cylinder of an internal combustion engine varies depending on an air-fuel ratio according to the fourth modification form of the invention.

As a fourth modification form of the control circuit, a control circuit 95 employs a combustion pressure sensor 9 which detects a combustion pressure in a specified cylinder of the internal combustion engine 100 as shown in FIG. 6. The combustion pressure varies with the increase of the air-fuel ratio of the air-fuel mixture gas in each cylinder of the internal combustion engine 100. When the combustion pressure varies so that the air-fuel ratio exceeds e.g. 22:1, it is impossible to maintain a stable burning condition in each cylinder of the internal combustion engine 100 as understood from FIG. 7.

The control circuit 95 further has a feedback circuit 95a, a distinction circuit 95b, an adjusting circuit 95c and an renewal circuit 95d.

The combustion pressure sensor 9 controls the injector 301 in each cylinder to make the air-fuel ratio approach to the lean air-fuel ratio (e.g. A/F=20) which is capable of controlling the variation of the combustion pressure within the predetermined value to maintain the stable burning condition in each cylinder of the internal combustion engine 100.

The feedback circuit 95a works as described in the first modification form of the invention.

The distinction circuit 95b detects an air-fuel ratio of the air-fuel mixture gas corresponding to a stable burning limit of the internal combustion engine 100 on the basis of an output from the attenuation detecting circuit 6.

The adjusting circuit 95c adjusts an amount of the injected fuel from the injector 301 to make the air-fuel ratio of the air-fuel mixture gas approach to a critical air-fuel ratio which is substantially corresponding to that of the stable burning limit in each cylinder of the internal combustion engine 100.

The renewal circuit 95d renews the lean air-fuel ratio to approach it to a target air-fuel ratio which is determined on the basis of the critical air-fuel ratio.

It is appreciated that the combustion pressure sensor may be incorporated into the spark plug, or otherwise the combustion pressure sensor may be installed independently of the spark plug.

While the invention has been described with reference to the specific embodiments, it is understood that this description is not to be construed in a limiting sense in as much as various modifications and additions to the specific embodiments may be made by skilled artisan without departing the spirits and scope of the invention.

What is claimed is:

1. In a burning condition detecting device in an internal combustion engine which includes an ignition circuit having a primary coil and a secondary coil connected to a spark plug by way of a diode and a series gap of a distributor, and having an interrupter means which on-off actuates a primary current flowing through the primary coil to induce secondary voltage across the secondary coil to apply a high voltage across electrodes of a spark plug through the diode and the series gap of the distributor so as to establish a spark discharge between electrodes of the spark plug:

the burning condition detecting device comprising:

a voltage charger circuit which on-off actuates the primary coil to induce a charging voltage in the secondary circuit either during establishing the spark discharge or during a predetermined period of time immediately after an end of the spark discharge, the charging voltage being applied to the spark plug to electrically charge a stray capacity inherent in the spark plug so as to form a sparkplug voltage;

a voltage divider circuit which divides the sparkplug voltage in accordance with a high impedance element and a low impedance element;

a voltage level detecting circuit which detects a sparkplug voltage waveform divided by the voltage divider circuit; and an attenuation detecting circuit which detects a degree of variation of an attenuation time period of the spark plug voltage waveform so as to determine a variation of an air-fuel ratio of an air-fuel mixture gas injected into a cylinder of the internal combustion engine by a fuel injector.

2. A burning condition detecting device in an internal combustion engine as recited in claim 1, wherein instead of the voltage charging circuit, an electrical energy resided in the ignition circuit is adapted to charge the stray capacity inherent in the spark plug immediately after the end of the spark discharge between the electrodes of the spark plug.

3. In a burning control device in an internal combustion engine which includes an ignition circuit having a primary coil and a secondary coil connected to a spark plug by way of a diode and a series gap of a distributor, and having an interrupter means which on-off actuates a primary current flowing through the primary coil to induce secondary voltage across the secondary coil to apply a high voltage across electrodes of a spark plug through the diode and the series gap of the distributor so as to establish a spark discharge between electrodes of the spark plug:

the burning control device comprising:

a voltage charger circuit which on-off actuates the primary coil to induce a charging voltage in the secondary circuit either during establishing the spark discharge or during a predetermined period of time immediately after an end of the spark discharge, the charging voltage being applied to the spark plug to electrically charge a stray capacity inherent in the spark plug so as to form a sparkplug voltage;

a voltage divider circuit which divides the sparkplug voltage in accordance with a high impedance element and a low impedance element;

a voltage level detecting circuit which detects a sparkplug voltage waveform divided by the voltage divider circuit; and an attenuation detecting circuit which detects a degree of variation of an attenuation time period of the sparkplug voltage waveform so as to determine a variation of an air-fuel ratio of an air-fuel mixture gas injected into a cylinder of the internal combustion engine by a fuel injector;

an air-fuel ratio sensor provided in an exhaust path of the internal combustion engine to detect an air-fuel ratio of the air-fuel mixture gas on the basis of an oxygen component and unconsumed fuel component in an exhaust gas of the exhaust path; and a control circuit comprising:

(a) a feedback means provided to control an amount of fuel injected from the fuel injector in each cylinder of the internal combustion engine, and feeding back to the injector so that the air-fuel ratio of the air-fuel mixture gas is a lean air-fuel ratio which is predetermined on the basis of data experimentally or calculated according to the running condition of the internal combustion engine;

(b) a distinction means provided to detect an air-fuel ratio of the air-fuel mixture gas corresponding to a stable burning limit in each cylinder of the internal combustion engine on the basis of an output signal from the attenuation detecting circuit;

(c) an adjusting means provided to adjust an amount of fuel injected from the fuel injector to make the air-fuel ratio of the air-fuel mixture gas approach to a critical air-fuel ratio which is substantially corresponding to that of the stable burning limit in each cylinder of the internal combustion engine;

(d) a renewal means provided to renew the lean air-fuel ratio to approach it to a target air-fuel ratio which is determined on the basis of the critical air-fuel ratio.

4. In a burning control device in an internal combustion engine which includes an ignition circuit having a primary coil and a secondary coil connected to a spark plug by way of a diode and a series gap of a distributor, and having an interrupter means which on-off actuates a primary current flowing through the primary coil to induce secondary voltage across the secondary coil to apply a high voltage across electrodes of a spark plug through the diode and the series gap of the distributor so as to establish a spark discharge between electrodes of the spark plug:

the burning control device comprising:

a voltage charger circuit which on-off actuates the primary coil to induce a charging voltage in the secondary circuit either during establishing the spark discharge or during a predetermined period of time immediately after an end of the spark discharge, the charging voltage being applied to the spark plug to electrically charge a stray capacity inherent in the spark plug so as to form a sparkplug voltage;

a voltage divider circuit which divides the sparkplug voltage in accordance with a high impedance element and a low impedance element;

a voltage level detecting circuit which detects a sparkplug voltage waveform divided by the voltage divider circuit; and an attenuation detecting circuit which detects a degree of variation of an attenuation time period of the sparkplug voltage waveform so as to determine a variation of an air-fuel ratio of an air-fuel mixture gas injected into a cylinder of the internal combustion engine by a fuel injector;

an air-fuel ratio sensor provided in an exhaust path of the internal combustion engine to detect an air-fuel ratio of the air-fuel mixture gas on the basis of an oxygen component and unconsumed fuel component in an exhaust gas of the exhaust path; and a control circuit provided to control an amount of fuel injected from the fuel injector on the basis of an output from the air-fuel sensor so that the air-fuel ratio of the air-fuel mixture gas is a target air-fuel ratio predetermined according to running conditions of the internal combustion engine, and detecting a burning condition in each cylinder of the internal combustion engine on the basis of the attenuation detecting circuit so as to adjust the amount of the injected fuel to make the burning condition substantially uniform in each cylinder of the internal combustion engine.

5. In a burning control device in an internal combustion engine which includes an ignition circuit having a primary coil and a secondary coil connected to a spark plug by way of a diode and a series gap of a distributor, and having an interrupter means which on-off actuates a primary current flowing through the primary coil to induce secondary voltage across the secondary coil to apply a high voltage across electrodes of a spark plug through the diode and the series gap of the distributor so as to establish a spark discharge between electrodes of the spark plug:

the burning control device comprising:

a voltage charger circuit which on-off actuates the primary coil to induce a charging voltage in the secondary circuit either during establishing the spark discharge or during a predetermined period of time immediately after an end of the spark discharge, the charging voltage being applied to the spark plug to electrically charge a stray capacity inherent in the spark plug so as to form a sparkplug voltage;

a voltage divider circuit which divides the sparkplug voltage in accordance with a high impedance element and a low impedance element;

a voltage level detecting circuit which detects a sparkplug voltage waveform divided by the voltage divider circuit; and an attenuation detecting circuit which detects a degree of variation of an attenuation time period of the sparkplug voltage waveform so as to determine a variation of an air-fuel ratio of an air-fuel mixture gas injected into a cylinder of the internal combustion engine by a fuel injector;

an air-fuel ratio sensor provided in an exhaust path of the internal combustion engine to detect an air-fuel ratio of the air-fuel mixture gas on the basis of an oxygen component and unconsumed fuel component in an exhaust gas of the exhaust path;

an oxygen sensor provided in an exhaust path of the internal combustion engine to detect whether an air-fuel ratio of the air-fuel mixture gas is more than a stoichiometric air-fuel ratio or not on the basis of an oxygen component and unconsumed fuel component in an exhaust gas of the exhaust path; and a control circuit provided to control an amount of fuel injected from the fuel injector on the basis of an output from the oxygen sensor so that the air-fuel ratio of the air-fuel mixture gas is the stoichiometric air-fuel ratio predetermined according to running conditions of the internal combustion engine, and detecting a burning condition in each cylinder of the internal combustion engine on the basis of the burning condition detecting device so as to adjust the amount of the injected fuel to make the burning condition substantially uniform in each cylinder of the internal combustion engine.

6. In a burning control device in an internal combustion engine which includes an ignition circuit having a primary coil and a secondary coil connected to a spark plug by way of a diode and a series gap of a distributor, and having an interrupter means which on-off actuates a primary current flowing through the primary coil to induce secondary voltage across the secondary coil to apply a high voltage across electrodes of a spark plug through the diode and the series gap of the distributor so as to establish a spark discharge between electrodes of the spark plug:

the burning control device comprising:

a voltage charger circuit which on-off actuates the primary coil to induce a charging voltage in the secondary circuit either during establishing the spark discharge or during a predetermined period of time immediately after an end of the spark discharge, the charging voltage being applied to the spark plug to electrically charge a stray capacity inherent in the spark plug so as to form a sparkplug voltage;

a voltage divider circuit which divides the sparkplug voltage in accordance with a high impedance element and a low impedance element;

a voltage level detecting circuit which detects a sparkplug voltage waveform divided by the voltage divider circuit; and an attenuation detecting circuit which detects a degree of variation of an attenuation time period of the sparkplug voltage waveform so as to determine a variation of an air-fuel ratio of an air-fuel mixture gas injected into a cylinder of the internal combustion engine by a fuel injector;

an angular detecting sensor provided to detect a variation of an angular velocity of a crank in the internal combustion engine;

a control circuit comprising:

(a) a feedback means provided to control an amount of a variation of an angular velocity of a crank within a certain range, and feeding back to the injector so that the air-fuel ratio of the air-fuel mixture gas is a lean air-fuel ratio which is predetermined according to running conditions of the internal combustion engine;

(b) a distinction means provided to detect an air-fuel ratio corresponding to a stable burning limit in each cylinder of the internal combustion engine on the basis of an output from the attenuation detecting circuit;

(c) an adjusting means provided to adjust the amount of the injected fuel to make an air-fuel ratio of the air-fuel mixture approach to a critical air-fuel ratio substantially corresponding to that of the stable burning limit in each cylinder of the internal combustion engine:

(d) a renewal means provided to renew the lean air-fuel ratio to approach it to a target air-fuel ratio which is determined on the basis of the critical air-fuel ratio.

7. In a burning control device in an internal combustion engine which includes an ignition circuit having a primary coil and a secondary coil connected to a spark plug by way of a diode and a series gap of a distributor, and having an interrupter means which on-off actuates a primary current flowing through the primary coil to induce secondary voltage across the secondary coil to apply a high voltage across electrodes of a spark plug through the diode and the series gap of the distributor so as to establish a spark discharge between electrodes of the spark plug:

the burning control device comprising:

a voltage charger circuit which on-off actuates the primary coil to induce a charging voltage in the secondary circuit either during establishing the spark discharge or during a predetermined period of time immediately after an end of the spark discharge, the charging voltage being applied to the spark plug to electrically charge a stray capacity inherent in the spark plug so as to form a sparkplug voltage;

a voltage divider circuit which divides the sparkplug voltage in accordance with a high impedance element and a low impedance element;

a voltage level detecting circuit which detects a sparkplug voltage waveform divided by the voltage divider circuit; and an attenuation detecting circuit which detects a degree of variation of an attenuation time period of the sparkplug voltage waveform so as to determine a variation of an air-fuel ratio of an air-fuel mixture gas injected into a cylinder of the internal combustion engine by a fuel injector;

a pressure sensor provided to detect a combustion pressure in a specified cylinder of the internal combustion engine;

a control circuit comprising:

(a) a fedback means provided to control an amount of a variation of a combustion pressure in each cylinder of the internal combustion engine within a certain range, and feeding back to the injector pressure sensor so that the air-fuel ratio of the air-fuel mixture gas is a lean air-fuel ratio which is predetermined according to running conditions of the internal combustion engine;

(b) a distinction means provided to detect an air-fuel ratio corresponding to a stable burning limit in each cylinder of the internal combustion engine on the basis of an output from the attenuation detecting circuit;

(c) an adjusting means provided to adjust the amount of the injected fuel to make an air-fuel ratio of the air-fuel mixture approach to a critical air-fuel ratio which is substantially corresponding to that of the stable burning limit in each cylinder of the internal combustion engine;

(d) a renewal means provided to renew the lean air-fuel ratio to approach it to a target air-fuel ratio which is determined on the basis of the critical air-fuel ratio.

* * * * *